United States Patent [19]

Petersen

[11] Patent Number: 4,844,432

[45] **Date of Patent: * Jul. 4, 1989**

[54] STAPLING APPARATUS FOR STAPLING FOLDED SHEET PRODUCTS

[75] Inventor: Godber Petersen, Augsburg, Fed. Rep. of Germany

[73] Assignee: M.A.N. Roland Druckmaschinen AG, Offenbach am Main, Fed. Rep. of Germany

[ * ] Notice: The portion of the term of this patent subsequent to Jun. 20, 2006 has been disclaimed.

[21] Appl. No.: 137,246

[22] Filed: Dec. 23, 1987

[30] Foreign Application Priority Data

Dec. 24, 1986 [DE] Fed. Rep. of Germany ..... 3644422

[51] Int. Cl.[4] ..... B42B 1/02

[52] U.S. Cl. ..... 270/53

[58] Field of Search ..... 270/37, 53, 58

[56] References Cited

U.S. PATENT DOCUMENTS

| | | | |
|---|---|---|---|
| 4,236,706 | 12/1980 | Schlough | 270/53 |
| 4,519,599 | 5/1985 | Mayer | 270/53 |
| 4,641,825 | 2/1987 | Mowry et al. | 270/53 |

FOREIGN PATENT DOCUMENTS

| | | |
|---|---|---|
| 278133 | 9/1914 | Fed. Rep. of Germany . |
| 1949769 | 4/1970 | Fed. Rep. of Germany . |
| 2631058 | 1/1978 | Fed. Rep. of Germany . |

*Primary Examiner*—Robert E. Garrett
*Assistant Examiner*—Therese M. Newholm
*Attorney, Agent, or Firm*—Frishauf, Holtz, Goodman & Woodward

[57] ABSTRACT

To permit simultaneous stapling of a plurality of folded sheet products (3) in compact space, the sheet products are opened in V shaped formation by carrying them on zig-zag or accordion-pleat carrier elements (1, 1'). The folded elements are transported to stapling systems (8–13), in a direction transverse to the central plane (20) of the folded products. Staple heads (13) move staples against the folded back of the folded products and are closed by a staple counter or closing elements (12) lowered into the open V of the opened folded products (3), preferably along the central plane (20) of the V (21). After stapling, the folded products are transported in direction reverse to the direction of movement to the stapling station, for storage, or delivery to a transport system (15).

12 Claims, 5 Drawing Sheets

STAPLING APPARATUS FOR STAPLING FOLDED SHEET PRODUCTS

Reference to related applications, assigned to the assignee of the present invention, the disclosure of which is hereby incorporated by reference:

U.S. Ser. No. 060,764, filed June 10, 1987, KOBLER et al now U.S. Pat. No. 4,828,242

U.S. Ser. No. 056,857, filed May 29, 1987, KOBLER et al now U.S. Pat. No. 4,807,865

U.S. Ser. No. 056,787, filed May 29, 1987, PETERSEN now U.S. Pat. No. 4,775,136

U.S. Ser. No. 111,042, filed Oct. 20, 1987, SCHNEIDER pending

U.S. Ser. No. 137,243, filed Dec. 23, 1987, PETERSEN pending

German Pat. No. 26 31 58

German Pat. No. 19 49 769.

The present invention relates to the handling of folded sheets, supplied in V formation from a storage element, for example, and more particularly to stapling a plurality of such folded sheets at a fold, back, or crease line.

BACKGROUND

German Pat. No. 26 31 58 describes a stapling apparatus in which products to be stapled are supplied by a transport system on rods, located on the transport system and spaced from each other. The rods engage into the folded back of the folded products to be stapled and are applied, horizontally, to a stapling station which includes stapling heads and counter staple deforming or folding elements or staple closers. The stapling apparatus of this type permits folded products to be stapled separately, sequentially. This, of course, is time consuming. German Pat. No. 19 49 769 describes a stapling apparatus in which the products to be stapled are supplied to a stapling station in saddle shape, that is, open towards the bottom.

If a plurality of stapling stations of this type are to be placed for essentially simultaneous stapling of a plurality of folded products, a large structure would result which, for simultaneous stapling of, for example, 30 or 50 folded products, would exceed the floor space which could, economically, be allotted thereto. Such vast structures would not be commercially acceptable.

Carrier structures which permit compact storage of folded elements are described in the referenced patent applications U.S. Ser. No. 060,764, filed June 10, 1987, KOBLER et al; U.S. Ser. No. 056,857, filed May 29, 1987, KOBLER et al; U.S. Ser. No. 056,787, filed May 29, 1987, PETERSEN. The carrier structures or, rather, the half-portions thereof are located on tracks and slidable thereon.

THE INVENTION

It is an object to provide a stapling arrangement for folded products which is compact and permits simultaneous stapling of a plurality of products while requiring only little floor space.

Briefly, the folded products are supplied from holders or carriers as described in the aforementioned referenced patent applications to a stapling apparatus in a direction transverse to a central plane of the folded sheet products. The stapling station has a plurality of stapling head-closer systems, operating simultaneously. A staple counter or closing elements are introduced simultaneously essentially along the central plane of the sheet products into the open V defined thereby opposite each stapling head, up to a predetermined position which defines a stapling plane. The stapling heads are then engaged from the opposite side, typically from below, against the back of the V to simultaneously introduce the staple which are closed by the stapling closing elements.

DRAWINGS

All the drawings are schematic and illustrate only those features necessary for an understanding of the invention, omitting all features which are conventional or form part, in general, of sheet transport apparatus.

DETAILED DESCRIPTION

Figure 1:
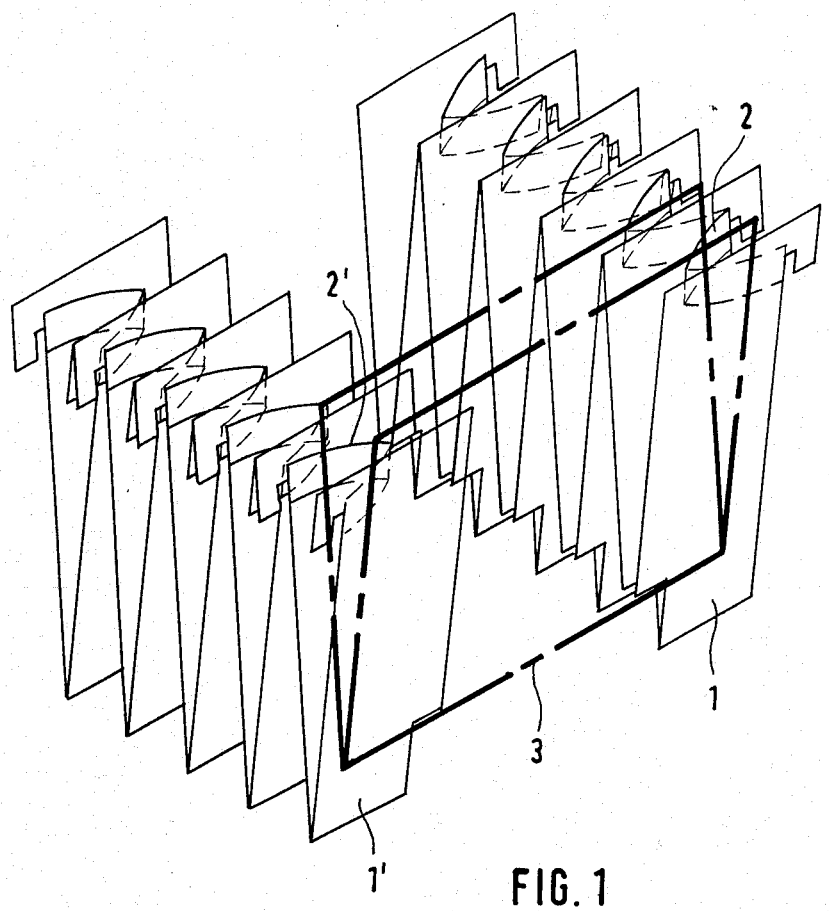
FIG. 1 illustrates an accordeon-like zig-zag carrier arrangement forming a transport and holding system for the sheets to be stapled by the apparatus of the present invention.

The present invention is particularly applicable to stapling apparatus in combination with a carrier structure which supplies the printed or folded products. The carrier structure is an accordeon-like arrangement, having zig-zag shaped carrier elements, including two halves 1, 1'. Each one of the halves 1, 1' has projecting fingers 2, 2' to permit opening of the respective half elements 1, 1'. The half elements 1, 1', upon pulling the fingers 2, 2' outwardly, permit opening the carrier structure. Preferably, the half elements 1, 1' open in V shape towards the top, and hold the folded products 3 suspended in the half elements 2, 2'. Upon pulling the fingers 2, 2' apart, the folded products 3 will, likewise, open to assume a generally V shape when looked at from the side. When folded together, the carrier structure can be placed in a storage region 4 (FIG. 3) for compact storage of folded products. The specific carrier structures, their shape, the way the carriers or transport systems are loaded or unloaded with folded products or other printed subject matter or the like, is described in detail in the referenced applications U.S. Ser. No. 060,764, filed June 10, 1987, KOBLER et al; U.S. Ser. No. 056,857, filed May 29, 1987, KOBLER et al; U.S. Ser. No. 056,787, filed May 29, 1987, PETERSEN. The carrier structures or, rather, the half elements 1, 1' thereof, are located in rails 5 to slide thereover. Upon increasing the lateral spacing of the rails 5—see FIG. 4—the half holders 1, 1' will move laterally so that the folded products 3 will be released and may fall downwardly between the two half elements 1, 1'.

Figure 2:
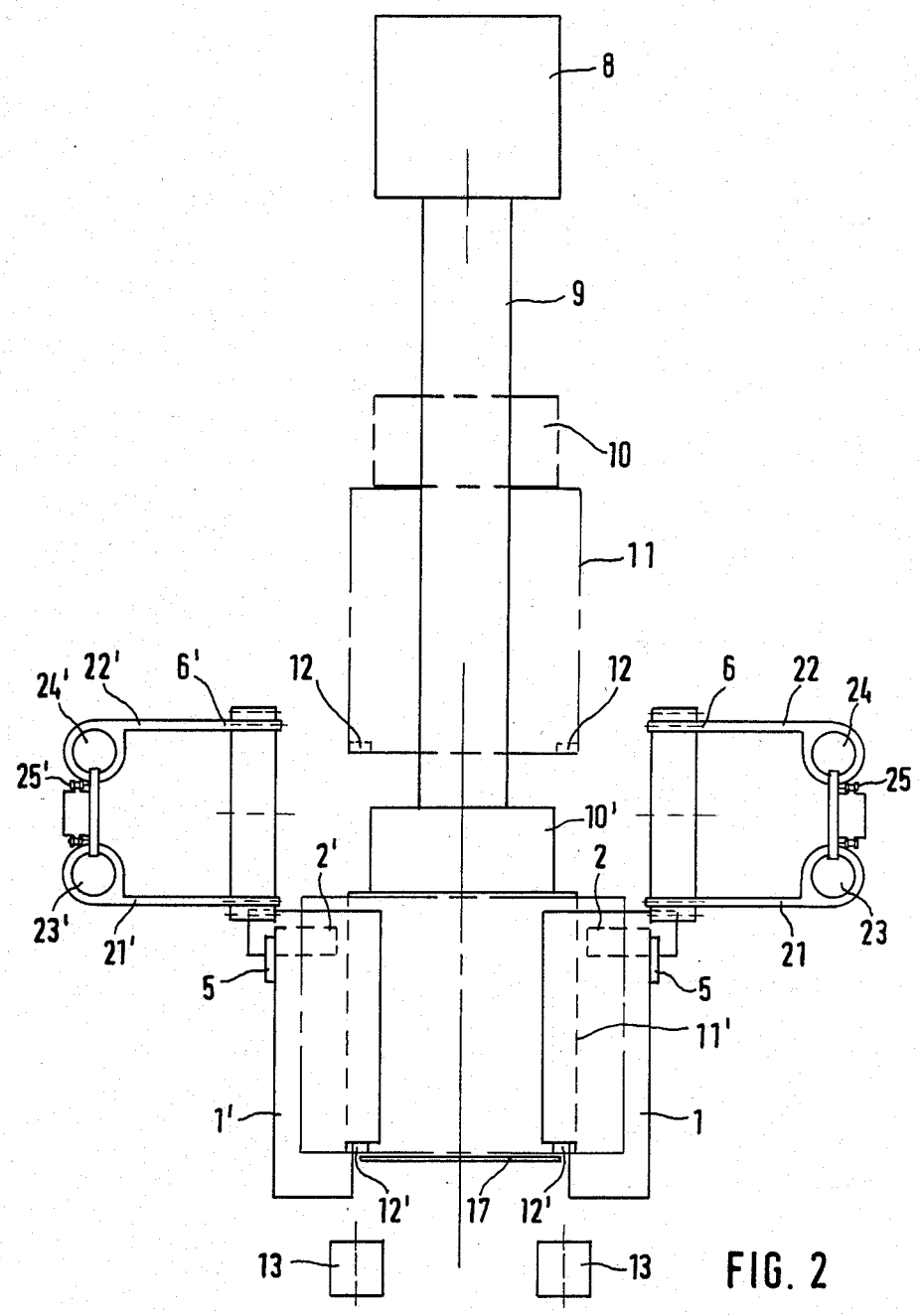
FIG. 2 is a front view of the stapling apparatus.
Figure 4:
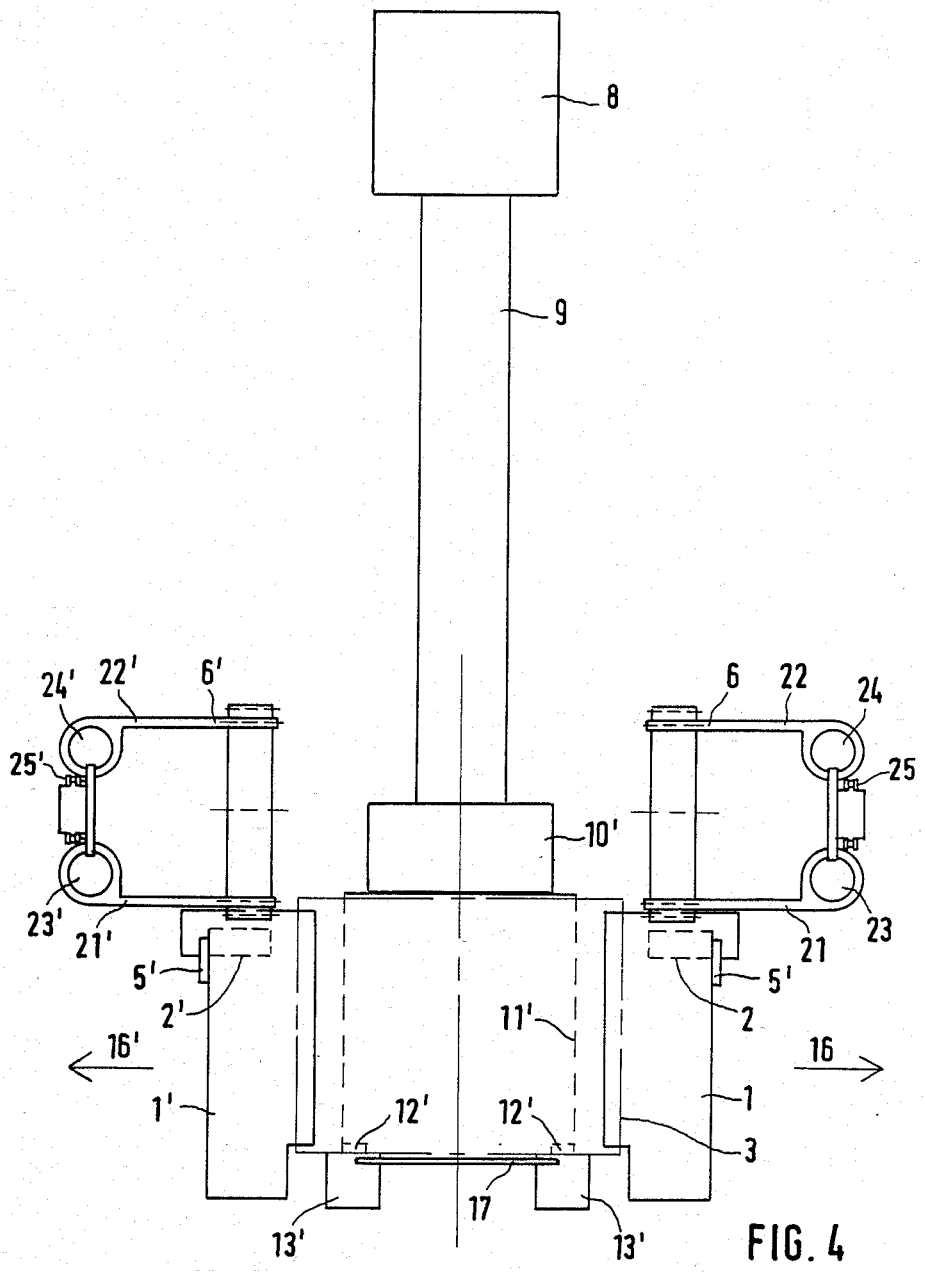
FIG. 4 is is a fragmentary view of the apparatus shown in FIG. 2, in operating position.

To transport the folded elements, compactly or spread apart, a transport worm 18 is provided. Reference, again, is made to the three above-identified applications for a detailed description. They can be removed from a storage zone by the worm 18 and then transported for example by chain elements 6, 6', having suitable engagement pins or the like in the direction of the arrow 7. As best seen in FIG. 4, two transport chains 6, 6' are provided, one on either side of the apparatus, to transport the respective halves 1, 1', permitting movement of the respective halves or portions of the carrier structure 1, 1' on the tracks 5, 5'. The chains 6, 6', driven by suitable drive means, pull the holder portions 1, 1' completely from the storage section 4 and open the holder portions 1, 1' so that folded products 3, within the holders, will likewise open to form an upwardly open V. The folds or backs of the folded products 3, which are to be stapled together, are supplied in this condition by the carrier structures 1, 1' to a stapling station having a plurality of stapling systems, each including a stapling head 13 and a counter or closing element 12 (FIG. 2).

Figure 3:
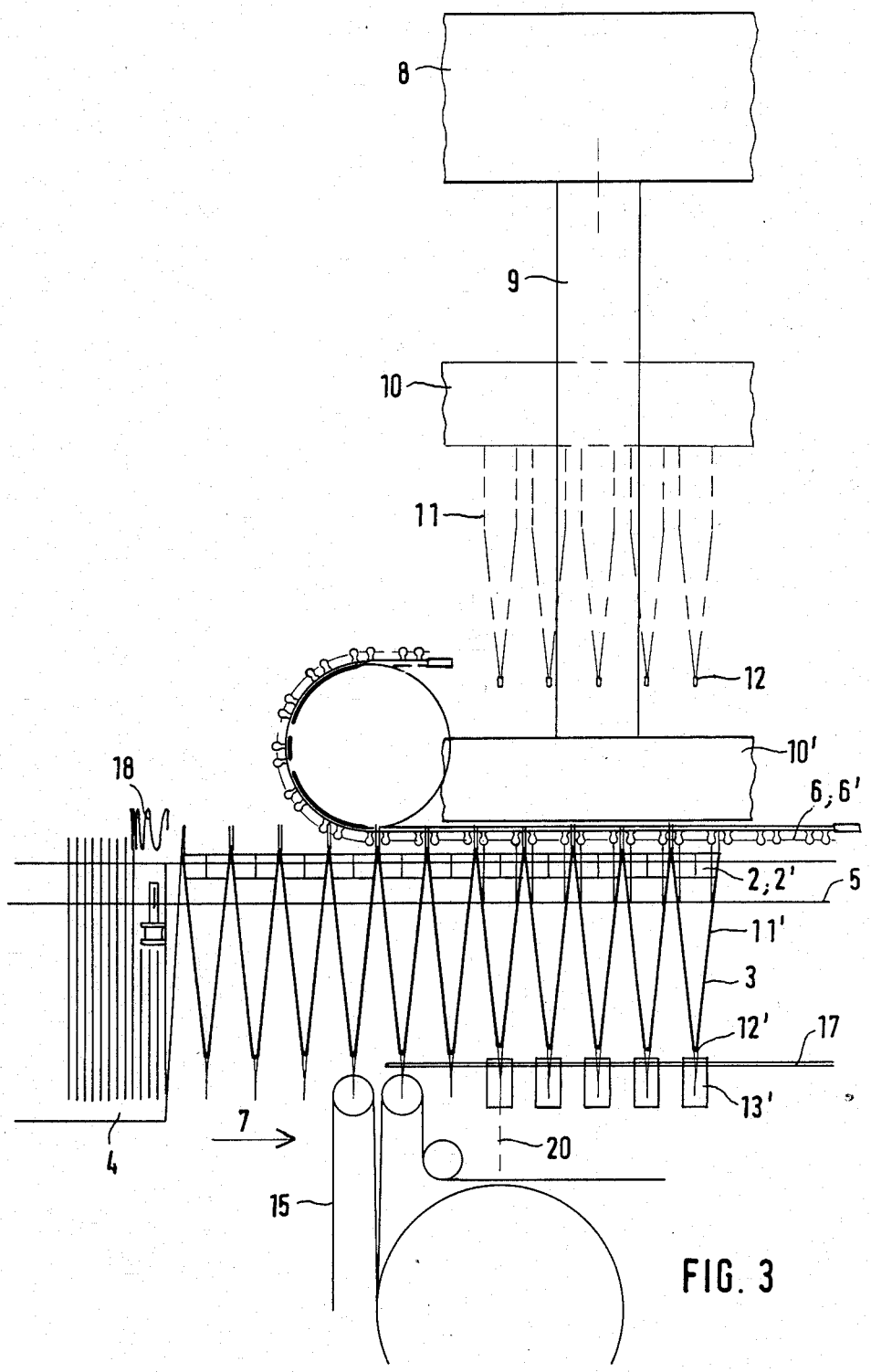
FIG. 3 is a side view of the stapling apparatus.

The stapling station includes a beam 10, suspended on a guide holder 9 which, in turn, is suspended on a beam 8. The beam 10 supports a plurality of V-shaped support holders 11, each of which terminate at their lower end in an essentially pointed edge, which has a counter plate or a staple counter closing element 12 (FIG. 5) secured thereto. The spacing of the elements 11, and hence of the closers 12, corresponds to the spacing of a plurality of stapling heads 13, located one behind the other with respect to the transport direction shown by arrow 7 (FIG. 3). The folded products 3 to be stapled are supplied to the stapling heads 13 by the chains 6, 6' in this spacing.

OPERATION

Figure 5:
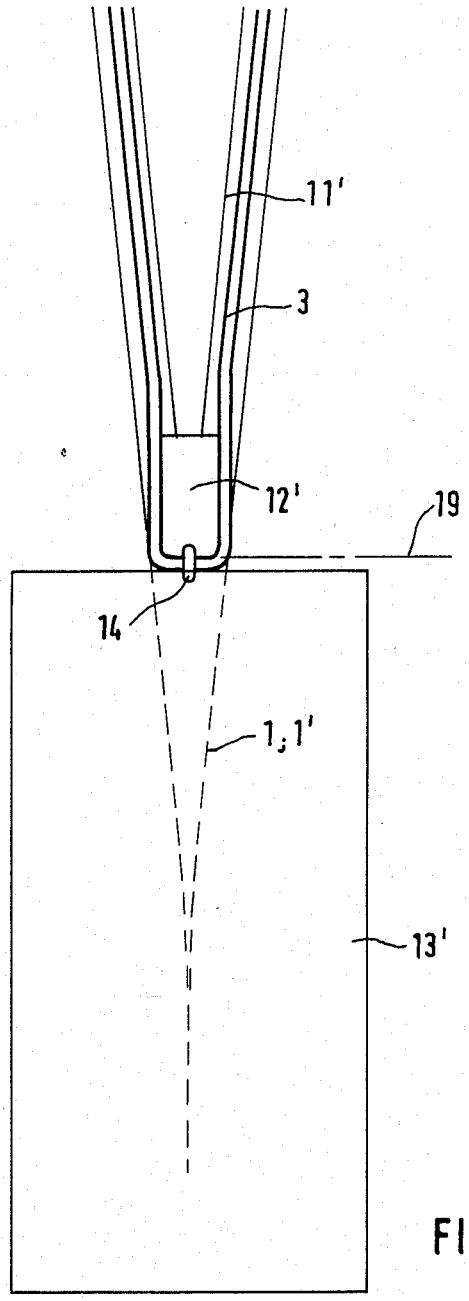
FIG. 5 is a schematic fragmentary enlarged view of the stapling region, and illustrating placement of a staple.

When the folded products 3, to be stapled, are in the position shown in FIG. 3, beam 10 holds the closers clear of the products 3. Beam 10 then is lowered to the position 10' (see also FIG. 4), so that the holders 11 and the counter closing elements 12 will be in closing position, that is, will assume the positions 11',—compare FIGS. 3 and 4 and, for the final position of the closer 12 at position 12', see FIG. 5. The holders 1, 1' and the folded products 3 are then stationary. The holder elements 11 themselves, preferably, are also V-shaped—see FIG. 5 in the position 11'—so that the folded products 3 can engage laterally against the carrier elements 1, 1' at the outside and, at the inside, against the support element 11'. This insures reliable stapling upon movement of the stapling heads 13 (FIG. 2) in the position 13' (FIGS. 3, 4), at which time the stapling operation itself is carried out. The staple closers 12, now in the position 12', are located in a stapling plane 19 (FIG. 5). A sheet-metal element at position 17 (FIG. 4) is located below the stapling plane 19, against which the back or fold of the folded products 3 can engage for support.

The sheets are transported from the storage stack 4 first by the worm 18 (FIG. 2) and then further pulled out by the chains 6, 6'. Since the holders 1, 1' are connected, pulling at the right side of the connected holders—with respect to FIG. 3—will cause the respective holders to separate even beyond the terminal end of the worm 18. As best seen in FIG. 3, the folded products 3 are supplied in transport direction 7 which extends transversely to a central plane 20 (FIG. 3) of the respective folded products.

The folded products, preferably, are supplied with the V open to the top. This is not necessary, however, and the structure of the present invention can also be used with all elements reversed, upside down, that is, with the opening of the V directed downwardly. The position of the stapling heads 13 and the closing elements 12 then also should be interchanged.

The reference patent applications describe supply of folded products, open at the top.

After stapling of the folded products, the transport chains 6, 6' can be reversed in direction, that is, counter the direction of the arrow 7 (FIG. 3) to move towards the left for restoring of the products on the storage stack 4. Thereafter, a subsequent series of folded products can be removed from the storage section 4. Alternatively, upon transfer or spreading of the rails 5, the now stapled folded products are released from the holders 1, 1' so that they can fall downwardly on a transport system 15, shown schematically as two belts, driven by a suitable drive wheel.

FIG. 5 illustrates, in detail, the staple 14, introduced from each stapling head against the counter element 12, and also illustrating the position of the folded products 3 between the holder—support structure 11 and the carrier structures 1, 1', respectively, all shown in the respective operating positions 11', 12', 13', respectively. The folding plane, up to which the staple closer 12 is introduced, is also shown in FIG. 5 at 19.

After stapling, the beam 10 is raised and then the folded products are moved by the respective transport chains 6, 6' counter the direction of the arrow 7 to the further transport device 15 or for storage.

The staple closing support 11 is preferably introduced into the open folded products 3 along the central plane 20 thereof extending transversely to the transport direction, as best seen in FIG. 3.

FIG. 4 illustrates release of the folded products, by laterally moving the rails 5 into a position 5' along the arrows 16, 16'. This releases the fingers 2, 2' from the region of the folded products. The stapling heads 13 are moved into the position 13' upwardly from below.

The transport chains 6, 6' are endless chains, carried over a return wheel—not shown—and of any suitable and standard construction. The drive of the fingers 2, 2' is obtained by guiding the chains over upper and lower arms 21, 22, 21', 22'—see FIG. 4. The arms 21, 22 preferably are slidable on guide elements 23, 24 extending longitudinally of the structure, that is, parallel to the chains 6, 6'. Rather than using driven sprocket wheels, the arms 21, 22, 21', 22' can engage against the chains 6, 6' and the arms 21, 22 are moved, in respectively opposite directions, by suitably operated chains 25, 25', to shift the folded products in the direction of the arrow 7 to align them for stapling and, after effected stapling, to return the folded products or to supply them to the further transport system 15 (FIG. 3). The stapling apparatus can simultaneously staple a plurality of folded products 3 while requiring only little space. Investigation has shown that up to 250 folded products can be stapled simultaneously, requiring a length of the folding apparatus of 15 meters. In accordance with preferred embodiments, the structure can be built in modular form, providing for an average of 50 stapling heads and counter elements 12, 13, requiring for such a structure a length of only 3 meters. In comparison a known stapling system, for example the arrangement shown in German Pat. No. 19 49 769 requires for simultaneous stapling of 50 folded products of a format of for example about $8\frac{1}{2} \times 11$ inches, or A4 metric format, about 15 meters. The stapling apparatus in accordance with the presence with the present invention, thus, requires only 1/5 of the floor space for equal capacity in comparison to known structures.

Various changes and modifications may be made within the scope of the inventive concept.

I claim:

1. The combination of means (4, 6) for supplying a plurality of folder products (3) including an accordion-like or zig-zag holder means (1,1') holding the folded products in essentially vertical position and in V shape, and guide means (5) for guiding the holder means, with folded products thereon, for sliding movement in said accordion-like zig-zag position, with a stapling apparatus (8–13) for stapling the folded products (3) at a fold line and having at least one stapling station having a plurality of stapling systems (12, 13), said holder means retaining the folded products (3) in open V-shape and stopped at the at least one stapling station, each stapling system including a stapling head (13) and a staple counter or closing element (12), and wherein said folded sheet product supply means (4, 6) supply said folded sheet products (3) in open V shape to the stapling station (8, 13) in a direction transversely to a central plane (20) of the sheet products (3); and means (8–11) are provided for introducing the plurality of staple counter or closing elements (12) of the respective stapling systems essentially along said central plane (20) of the folded sheet products into the open V thereof up to a predetermined stapling plane (19) within said open V, and for engaging the plurality of stapling heads (13) against the fold line.

2. The combination of claim 1, wherein said folded sheet product supply means (6, 6') transports the folded products (3) in open V formation;

said plurality of stapling systems are located in the direction of transport of said supply means; and said supply means supply said folded products to said stapling systems with a spacing corresponding to the spacing of said stapling systems.

3. The combination of claim 1, wherein the guide means comprise guide rails (5) guiding the folded products for sliding movement in accordion-like or zig-zag position.

4. The combination of claim 3, further including carrier elements having left and right portions (1, 1') and supporting the V-shaped folded products.

5. The combination of claim 4, wherein the carrier elements are suspended on said guide rails (5), and the folded products (3) are transported with the V open towards the top.

6. The combination of claim 4, wherein each one of the stapling systems includes a staple counter or closing element support or holder means (11) dimensioned to permit engagement into the open V (2') of the folded product for positioning of the staple counter or closing element (12) at said stapling plane (19).

7. The combination of claim 6, wherein said staple counter element introduction means includes a support beam (10) supporting a plurality of said support or holder means (11).

8. The combination of claim 1, wherein a storage section (4) is provided for storing a plurality of folded products on a plurality of holder means (1, 1');

said folded product supply means includes a worm (18) to remove selected holder means (1, 1') from said storage section, and an endless longitudinal transport means (6, 6') engageable with said holder means after removal of respective holder means from said storage section, said endless longitudinal transport means engaging said holder means at selected positions to pull out the holder means in zig-zag accordeon form and separate adjacent sheets of the folded sheet products to form said open V;

and wherein said holder means (1, 1') includes fingers (2) engaging the sheets of the folded products to assist spreading thereof.

9. The combination of claim 1, further including guide rails (5, 5') retaining separate element portions (1, 1') thereon, said folded products (3) being suspended in said carrier element portions;

and an arrangement releasing said folded products from said carrier element portions to permit said folded products, after stapling, to be removed by a further transport means (15).

10. The combination of claim 9, wherein said folded sheet supply means transport said folded sheets in a first direction (7) to said stapling station;

and further including an arrangement to release stapled folded products from said carrier element portions (1, 1') upon movement of said folded sheet supply means in reverse direction.

11. The combination of claim 1, wherein the stapling station comprises a support member (8) for supporting said plurality of staple counter and closing elements (12), said support member being movable between a clearing position in which said stapling counter or closing elements (12) are clear of the folded products (3), and a closing position in which said stapling counter or closing elements are in staple closing position for simultaneously placing said stapling counter and closing elements in said closing position.

12. The combination of claim 1, wherein said means for introducing the plurality of staple counter or closing elements within said open V of the folded sheet products introduces the plurality of staple counter or closing elements simultaneously within said open V for simultaneous stapling of the plurality of folded products (3).

* * * * *